United States Patent [19]

Peterson

[11] Patent Number: 4,494,345

[45] Date of Patent: Jan. 22, 1985

[54] BACK FLOW VALVE

[76] Inventor: Bruce M. Peterson, 313 Elizabeth St., Detroit Lakes, Minn. 56501

[21] Appl. No.: 407,695

[22] Filed: Aug. 12, 1982

[51] Int. Cl.[3] ..... F16K 31/34

[52] U.S. Cl. ..... 137/414; 251/5

[58] Field of Search ..... 137/488, 485, 486, 414, 137/413, 412, 362; 251/5

[56] References Cited

U.S. PATENT DOCUMENTS

| | | | |
|---|---|---|---|
| 1,991,081 | 2/1935 | Charpier | 137/412 |
| 2,756,959 | 7/1956 | Hill | 251/5 |
| 3,145,967 | 8/1964 | Gardner | 251/5 |
| 4,268,005 | 5/1981 | Raftis et al. | 251/5 |

*Primary Examiner*—Alan Cohan

*Attorney, Agent, or Firm*—Jacobson & Johnson

[57] ABSTRACT

A sewer back flow valve having sensing means located at the top of the sewer line and an inflatable annular bladder responsive to a sensing means to permit passage of sewage through the annular bladder under normal water level conditions and operable to prevent back flow of sewage through the annular bladder under high water level conditions.

8 Claims, 5 Drawing Figures

AIR SUPPLY
32
33
31
30
10
34
41
13
40
59
11
21
15
14
17
18
16
20
12

AIR SUPPLY
32
33
34
31
30
40
9
14
17
16
P1

BACK FLOW VALVE

FIELD OF THE INVENTION

This invention relates generally to valves and, more specifically, to a sewer valve to prevent back flow of sewage into a structure during abnormally high water conditions.

DESCRIPTION OF THE PRIOR ART

The concept of back flow valves for use in sewer lines to prevent back flow of sewage into structures is known in the art. Basically, the prior art back flow valves use some type of butterfly or flap mechanism to close the sewer pipe during conditions of flooding or high ground water. Unfortunately, the prior art back flow valves have been characterized by failure to properly seal the sewer pipe and thereby being ineffective to prevent back flow of sewage into the structure. Typically, the problem of back flow occurs after a heavy rain which raises the ground water level above the sewage lines. If the underground sewage lines are only slightly above the normal underground water level the combination of ground water run off and the rise in the ground water level causes the water to back up in the sewer line and, thus, prevents discharge of sewage. Not only can the water entering the sewage line prevent sewage discharge but in certain locations the elevation of the structures are sufficiently low so that if the water level continues to rise, it causes the sewage to flow backwards into the structure through the toilet bowl or the floor drains. The present invention provides a solution to the problem of sewage back flow by providing an annular inflatable valve having a central opening that can be sealed shut by inflating an annular bladder to completely seal off the sewer line in response to a high water level in the sewer line, yet the inflatable valve is also responsive to a low water level in the sewer line to permit the annular bladder to deflate and thereby permit normal sewage discharge when the water level in the sewage line decreases to a predetermined level.

BRIEF SUMMARY OF THE INVENTION

Briefly, the present invention comprises a sensing means located in the sewer line which comprises a float that is suspended in the top half of the sewer line. The float operates a control valve that controls a supply of high pressure air to an annular inflatable bladder. The annular inflatable bladder is mounted in the sewer line upstream of the float and is connected to the supply of high air pressure by the control valve. In response to a high water level in the sewer line, the float is displaced upward thereby activating the control valve to permit the pressurized air to inflate the annular inflatable bladder. The high pressure air causes radial inward expansion of the annular bladder resulting in the bladder sealing the sewer line to prevent back flow of sewage through the sewer line. As the water level in the sewer line decreases and falls below a predetermined level, the float is displaced downward which deactivates the control valve to permit discharge of the pressurized air in the inflatable valve. As the pressurized air discharges from the inflatable bladder, the bladder deflates and the natural elasticity of the bladder contracts the bladder thereby opening the sewer line to again permit the normal flow of sewage therethrough.

DESCRIPTION OF THE PREFERRED EMBODIMENT

Figure 1:
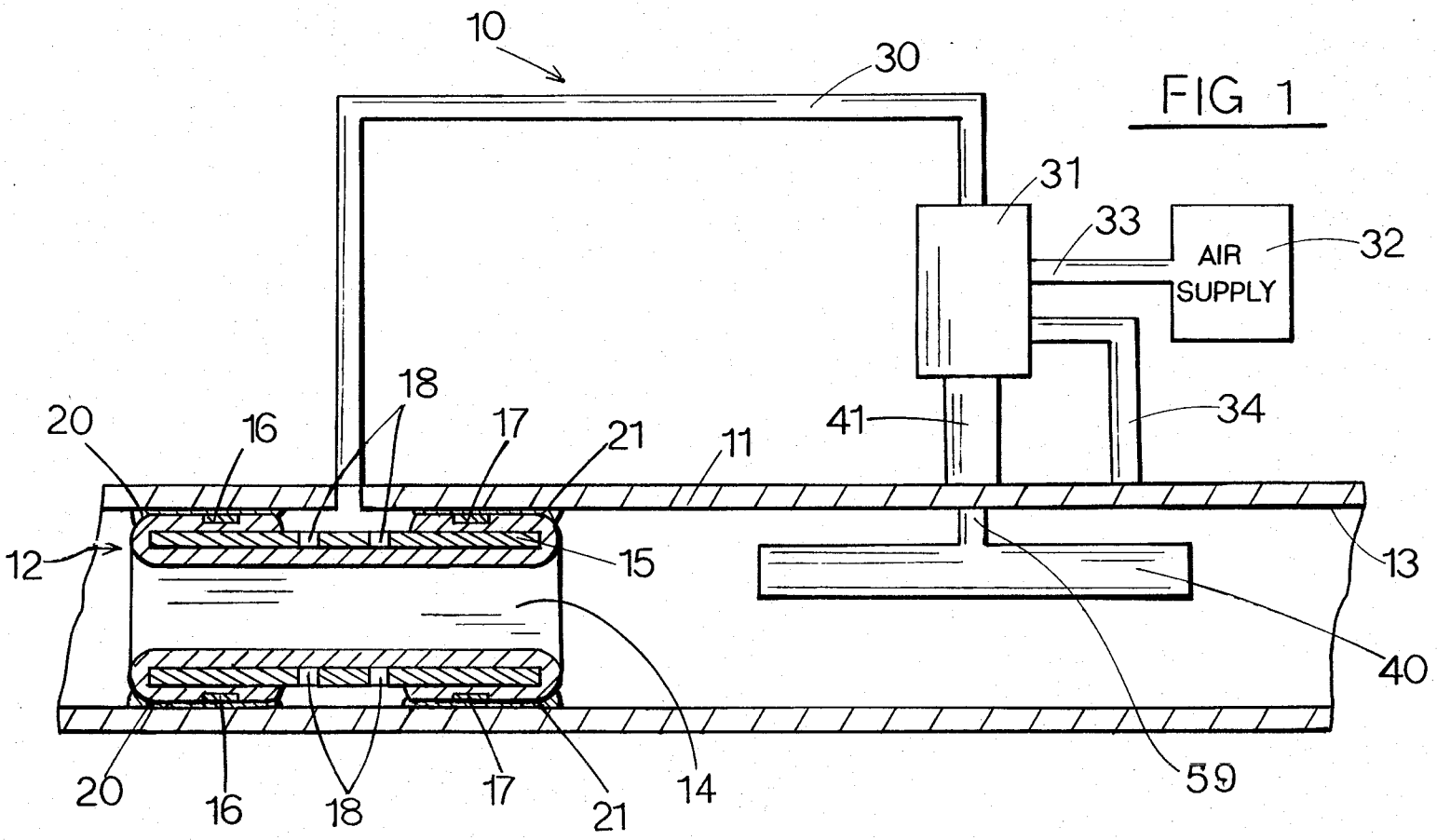
FIG. 1 is a sectional view of the sewer line with a sensing mechanism and an inflatable valve in an open condition.

Referring to FIG. 1, reference numeral 10 generally designates the back flow system of the present invention which is located in sewer line 11 having an interior surface 13. An annular inflatable bladder valve 12 is located in sewer line 11 and is sealed to the interior surface 13 of sewer line 11 with a sealant such as silicone or the like. Typically, inflatable valve 12 is located at the entrance of the sewer line into a structure. Inflatable valve 12 comprises a rigid cylindrical pipe 15 having a cylindrical elastic material 14 stretched through pipe 15 and folded around the ends of pipe 15. Preferably elastic material 14 is gum rubber or the like since it has the characteristic of elasticity and does not readily break down when exposed to sewage for prolonged periods of time. The folded back ends of elastic material 14 are held against the exterior surface of pipe 15 by adjustable bands 16 and 17 which can be circumferentially squeezed to hold the ends of material 14 in contact with pipe 15. To insure there is no air leakage around the exterior of valve 12 an annular layer of sealant 20 is located at the junction of one end of valve 12 with the interior surface 13 and a second annular layer of sealant 21 is located at the junction of the opposite end of valve 12 with the interior surface 13. Normally, the coaction of the sealant 20 and 21 and the friction fit of the inflatable valve 12 in the sewer line prevent lateral displacement of inflatable valve 12 in line 11; however, if desired, pipe 15 could be affixed to the interior surface 13 to prevent displacement of inflatable valve 12. Pipe 15 has a plurality of openings located around the central portion to permit flow of air into the space between the interior surface of pipe 15 and elastic material 14 adjacent to the interior surface of pipe 15. Pipe 15 is made from a rigid material that holds its shape so as to function as a support for the expandable annular bladder 14 which is made from an elastic material that expands or contracts in response to air pressure in the bladder.

A pipe 30 connects inflatable valve 12 to a control valve 31 which is connected to a source of high pressure air 32 through a pipe 33. Similarly, a vent pipe 34 connects control valve 31 to sewer line 11.

Figure 2:
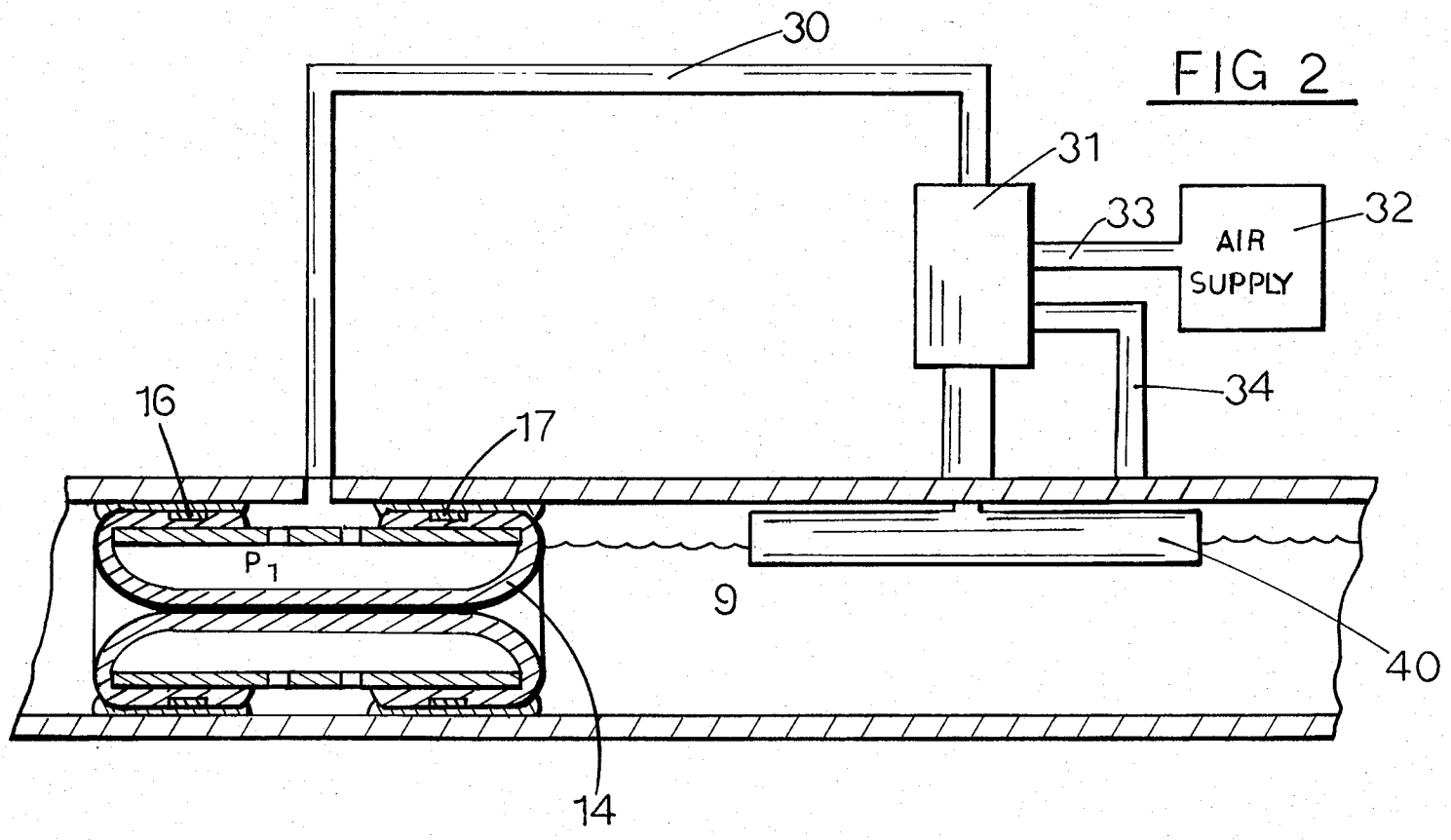
FIG. 2 is a sectional view with the sensing mechanism and inflatable valve in an inflated or closed position.

To illustrate the operation of my inflatable back flow valve 12 reference should be made to FIG. 1 which shows float 40 located at the top of sewer line 11 and suspended a slight distance downward from the upper interior surface 13 of sewer line 11. Typically, in this condition the top of float 40 may be on the order of 1 inch from the top surface of sewer line 11 with the total permissible travel of float 40 being on the order of 1 inch or less. In the condition shown in FIG. 1 inflatable valve 12 is in an open condition. In the open condition sewage flows from left to right through annular inflatable bladder 14, sewage line 11 and eventually discharges into the treatment system. Under normal operating conditions perhaps only the bottom ⅓ or less of the sewage line carries the sewage so that the sewage discharging through sewer line 11 never contacts float 40 since the flow level of sewage is always below the lowest portion of the float 40 which is located in the upper half of sewage line 11. FIG. 2 illustrates what occurs when water backs up in sewage line 11, such as due to rains or floods. If the water in sewage line 11 has increased to the level indicated in FIG. 2 two things have occurred. First, float 40 is displaced upward with the upward displacement of float 40 permitting air from air supply source 32 to flow through valve 31 to pipe 30 and into the annular inflatable bladder valve 12. Second, the pressurized air inflates and expands the annular bladder 14 causing it to expand radially inward. The radially inward expanding of the elastic material of annular bladder 14 forces the elastic bladder members to seal against itself to form an air- and water-tight seal through the center of bladder valve 12. With bladder 14 sealed against itself it prevents back flow of water and sewage into the structure should the water level continue to rise. That is, if the water level and hence the pressure in the sewage line continue to rise, the inflatable bladder 14 is pressurized to a predetermined pressure that is sufficiently high to insure that the water pressure in the sewage line cannot force its way through the center of bladder 14.

One characteristic of the elastic material of bladder 14 is that it will be resistant to the acids, etc. that are found in the sewer system. In addition, when the valve 12 is in the closed condition as shown in FIG. 2 the elastic material of bladder 14 must return to its original shape so as to provide a passageway for the sewage to flow therethrough. Therefore, either an elastic material or some retracting mechanism must be used to permit bladder 14 to return to its normally open position.

Figure 3:
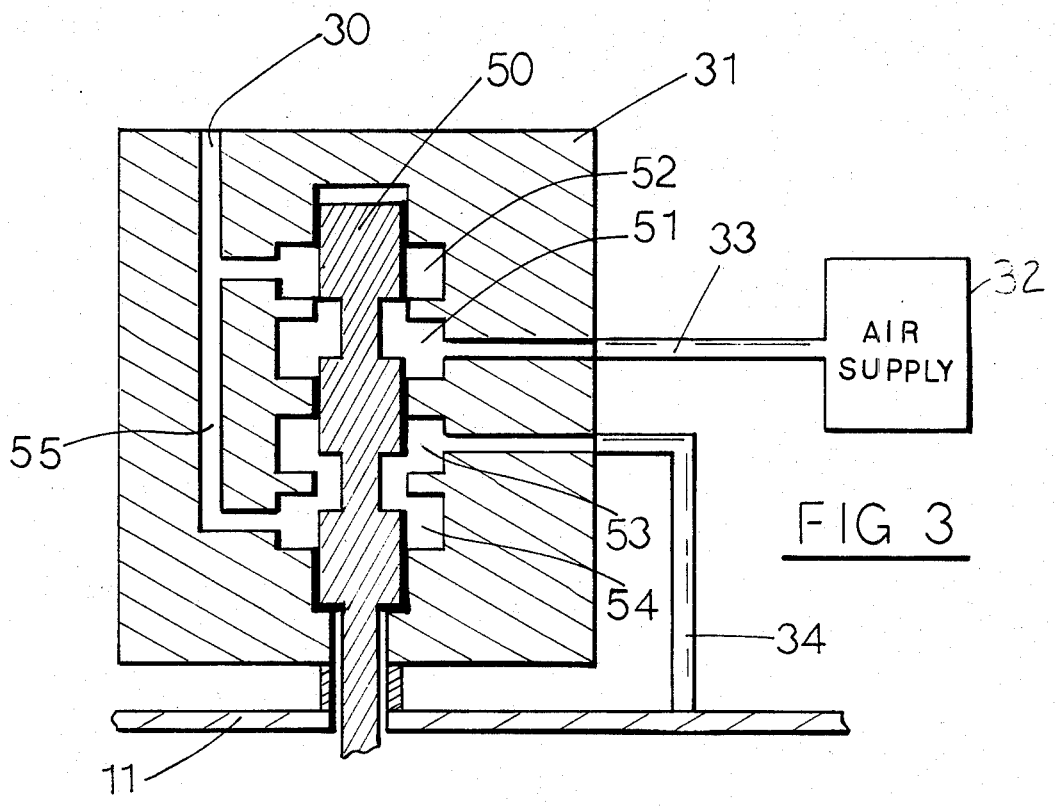
FIG. 3 is a sectional view of the control valve in the closed condition.
Figure 4:
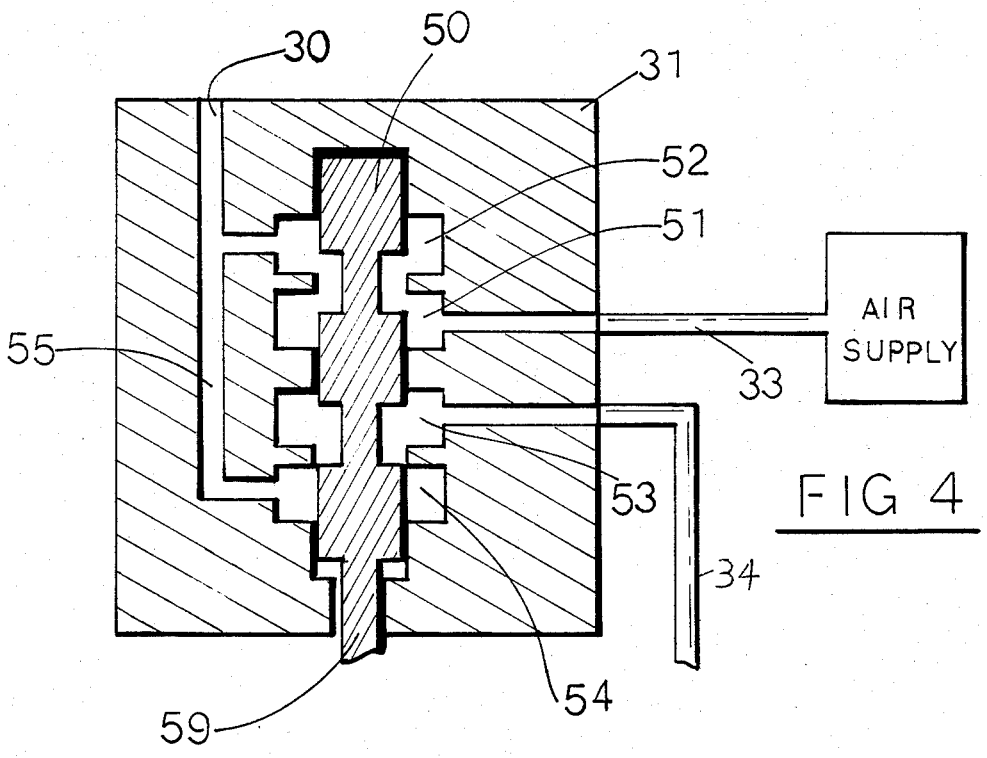
FIG. 4 is a sectional view of the control valve in the open position.

Referring to FIG. 3, the details of a typical control valve 31 are shown in greater detail. FIG. 3 shows control valve 31 in the normal or low water condition. In the normal condition air supply 33 connects to a plenum chamber 51 in control valve 31. FIG. 3 shows plenum chamber 51 in the closed condition since spool 50 blocks off plenum chamber 52 to prevent flow of air from chamber 51 to chamber 52. Similarly, a plenum chamber 53 and 54 are located around the lower two sections of spool 50. FIG. 3 shows spool 50 in the down position while FIG. 4 shows spool 50 in the up position. When spool 50 is in down position the air in chamber 51 is prevented form entering pipe 30 through plenum chamber 52. As float 40 rises in response to a high water condition, it raises spool 50 upward to the position shown in FIG. 4. In the up position the air from air supply 33 is permitted to enter plenum chamber 51, flow around and into plenum chamber 52 wherein it flows into pipe 30 and through openings 18 to pressurize inflatable valve 12 to the condition shown in FIG. 2.

FIG. 4 also shows how the air supply maintains inflatable valve 12 in a pressurized condition since plenum chamber 54 is sealed off to prevent flow of air into passage 55, i.e., passage 55 is blocked by the lower section of spool 50. Should the water level decrease float 40 drops to the down position (FIG. 1) thereby cutting off the supply of pressurized air 32 to maintain inflatable valve 12 in a closed condition, that is, the air in inflatable valve 12 flows back through pipe 30, passage 55 into plenum chamber 54 and 53 and discharges into sewer line 11 through pipe 34. While air is vented to the sewer line 11 it is apparent that the air could, if desired, be vented above ground. As air discharges from bladder 14 the elasticity of inflatable bladder 14 causes bladder 12 to contract to the position shown in FIG. 1 thereby returning inflatable valve 12 to normal operating condition in which sewage can flow therethrough.

While the system is shown with use of air as the fluid for pressurizing annular inflatable bladder 14 it is evident that other fluids such as liquids could be used to pressurize bladder 14.

Figure 5:
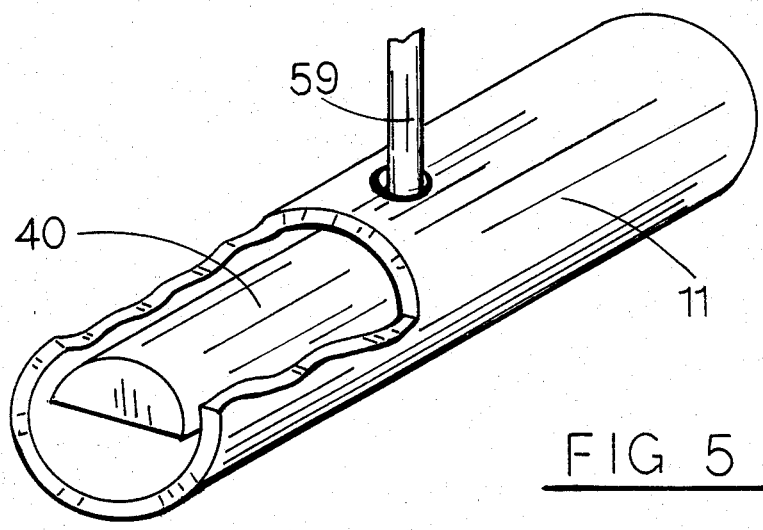
FIG. 5 is a perspective view showing the float that controls the inflatable valve.

FIG. 5 shows a cut-away of sewer pipe 11 to illustrate float shank 59 which extends upward through sewer line 11. Float 40 has a semicircular shape that conforms to the interior of sewer line 11 thereby permitting float 40 to operate in the region close to the top of sewer line 11. Float 40 is designed with sufficient length and volume to provide the necessary buoyancy forces to operate valve 31. Typically, float 40 may be in the order of 2 to 3 feet in length. Under normal operation conditions it is preferred that float 40 be immersed so that approximately ⅔ of the volume of float 40 is immersed in water before sufficient buoyancy forces are generated to raise float 40 and shank 59 to activate control valve 31 for closing inflatable valve 12.

I claim:

1. An inline back flow valve for a septic system or the like comprising:

a fluid passageway for flow of fluids therethrough, said fluid passageway having an upper portion and a lower portion;

means for determining that a condition of back flow is occurring in said fluid passageway;

said means including a float located in the upper portion of said fluid passageway to permit fluid to flow beneath said float when no back flow condition exists;

said means adaptable to be connected to a source of pressurized fluid;

inflatable means mounted in said fluid passageway, said inflatable means operable for inflating to thereby seal said fluid passageway to prevent back flow of fluid through said fluid passageway when said means supplies a pressurized fluid to said inflatable means;

said inflatable means and said means for determining that a condition of back flow is occurring located in line in said fluid passageway;

a first fluid passage connected to said inflatable means to supply pressurized fluid to inflate said inflatable means; and a second fluid passage connected to said inflatable means to vent pressurized fluid to deflate said inflatable means.

2. The back flow valve of claim 1 wherein said inflatable means comprises an annular inflatable bladder.

3. The invention of claim 2 wherein said annular inflatable bladder comprises gum rubber.

4. The invention of claim 1 wherein said float is an elongated shape that conforms to the shape of said fluid passageway.

5. The invention of claim 1 wherein said inflatable means including a cylindrical pipe having a first end and second end and an inside surface and an outside surface;

said inflatable means including cylindrical elastic material, said cylindrical elastic material having a first end and a second end, said cylindrical elastic material located inside said cylindrical pipe and extending past said first end and second end of said cylindrical pipe; at least one of said ends of said cylindrical elastic material folded over one of the ends of said cylindrical pipe and onto the outside surface of said cylindrical pipe; and means for holding said cylindrical elastic material in a sealing relationship on the outside of said cylindrical pipe.

6. The invention of claim 5 wherein said inflatable means is sealed to said fluid passageway through the coaction of a sealant and a friction fit between said inflatable means and said fluid passageway.

7. The invention of claim 6 including a spool valve for directing pressurized fluid into said inflatable means when a back flow condition exists and for venting the pressurized fluid from said inflatable means when the back flow condition is terminated.

8. The invention of claim 4 wherein at least $\frac{2}{3}$ of the volume of said float must be immersed in a fluid before said inflatable means is pressurized to seal said fluid passageway.

* * * * *